US012644283B2

(12) United States Patent
McKechnie et al.

(10) Patent No.: US 12,644,283 B2
(45) Date of Patent: Jun. 2, 2026

(54) BUILDING STUD FOR UTILITY SERVICES

(71) Applicant: Studco Australia Pty Ltd., Croydon South (AU)

(72) Inventors: Simon Mark McKechnie, Croydon South (AU); Benjamin Gordon Stevens, Croydon South (AU)

(73) Assignee: STUDCO BUILDING SYSTEMS US, LLC, Webster, NY (US)

( * ) Notice: Subject to any disclaimer, the term of this patent is extended or adjusted under 35 U.S.C. 154(b) by 146 days.

(21) Appl. No.: 18/354,189

(22) Filed: Jul. 18, 2023

(65) Prior Publication Data

US 2024/0309641 A1 Sep. 19, 2024

(30) Foreign Application Priority Data

Mar. 16, 2023 (AU) ..... 2023900708
Mar. 21, 2023 (AU) ..... 2023900773

(51) Int. Cl.
*E04C 2/52* (2006.01)
*E04B 2/72* (2006.01)

(52) U.S. Cl.
CPC ..... *E04C 2/521* (2013.01); *E04B 2/72* (2013.01)

(58) Field of Classification Search
CPC .... E04C 2/521; E04B 2/72; E04B 2002/7488; E04B 2/789; E04B 2/7457
See application file for complete search history.

(56) References Cited

U.S. PATENT DOCUMENTS 3,461,638 A * 8/1969 Balinski ..... E04B 2/789 52/483.1
5,943,838 A * 8/1999 Madsen ..... E04B 2/789 52/656.1
5,964,071 A * 10/1999 Sato ..... E04B 2/763 52/656.1
6,199,336 B1 * 3/2001 Poliquin ..... E04B 2/58 52/261
9,091,056 B2 * 7/2015 Stauffer ..... E04C 5/0645
9,109,361 B2 * 8/2015 Daudet ..... E04C 3/04
9,523,196 B2 * 12/2016 Rice ..... E04B 2/762
9,732,520 B2 * 8/2017 Daudet ..... F16B 9/056
11,008,753 B2 * 5/2021 Daudet ..... E04B 2/763
2001/0004820 A1 * 6/2001 Poliquin ..... E04B 2/58 52/766
2002/0194812 A1 * 12/2002 Attalla ..... E04B 2/789 52/846
2004/0172912 A1 * 9/2004 Brunt ..... E04B 2/763 52/698

(Continued)

FOREIGN PATENT DOCUMENTS

WO WO-2016095937 A1 * 6/2016 ..... E04B 2/789

*Primary Examiner* — Babajide A Demuren
(74) *Attorney, Agent, or Firm* — Woods Oviatt Gilman LLP; Katherine H. McGuire, Esq.

(57) ABSTRACT

A building stud (2) comprising a web (4) and first and second flanges (6, 8) formed with and depending from said web (4); a member (18) formed in said web (4) by a continuous cut (10) made in said web (4) and located in an operable position in which the member (18) is not located in a plane (21) of the web (4); an aperture (24) formed in the web (4) resulting from the member (18) being located in said operable position; wherein at least one conduit or cable (38, 40, 42, 44) is adapted to be secured to said member (18) and extends through aperture (24).

14 Claims, 10 Drawing Sheets

(56) References Cited

U.S. PATENT DOCUMENTS

2007/0251186 A1* 11/2007 Rice ..... E04B 2/763
52/483.1
2024/0318428 A1* 9/2024 Al-Haboobi ..... E04C 3/32

* cited by examiner

BUILDING STUD FOR UTILITY SERVICES

FIELD OF THE INVENTION

This invention relates to an improved building stud for utility services. More particularly the invention relates to a building stud having at least one aperture in the web of the stud to enable the fixing of multiple utility services of various sizes, such as cables for air, suction, gas, electricity, data and water to extend through the stud and other studs in a building component such as in a wall of a building.

BACKGROUND OF THE INVENTION

Studs used in the construction of buildings, and in particular metal studs, usually are provided with a single pre-cut hole located along the web of the stud to accommodate services such as electrical cables, gas cables and plumbing conduits that have to be threaded through the hole of a metal stud and other metal studs in the same construction such as a wall. When installing the studs they are usually aligned in such a way that the pre-cut holes are located at about the same height. Protective bushings such as rubber or polyethene grommets are placed against the edges that form the hole so that there is no rough or sharp edge on that part of the steel stud that could damage cables, conduits or lines that go through the pre-cut holes.

Even though pre-cut holes are supplied in each of the studs, there are situations where mechanical trade crews need to create additional cut-outs in the stud to allow for the installation of multiple utilities or oversize utilities. This is an important issue when installing medical gas reticulation systems for hospitals or laboratories. Generally, gas pipelines are pulled through each of the apertures provided along the length of the studs. However, when trade crews are required to make further cuts in the stud, in addition to the already supplied holes, in order to fit the utility services, this can have a negative impact on the structural performance of the stud. When a trade person makes notches, cuts or bores/holes in the metal stud members, that trade person has to take into consideration the effects on the structural integrity of the whole system including the studs. Incorrectly cutting and notching of a stud can impact the axial capacity, the shear and web crippling strength, the bending moment and the stiffness of the stud.

Although there are clear restrictions on cutting into studs, as provided by various manufacturers, there are some instances where for example carpenters correctly install internal walls, then plasterers line one side with plaster board. It is then left to plumbers and electricians to install the utility conduits and pipes and cables. After this, the plasterer would finish the lining of the other side of the wall with plaster board and would generally find non-compliant cut-outs. Sometimes penetrations have the entire span width of the stud missing from the stud to the point where the flanges are buckling under the weight of the lining board. Such excessive removal of stud material deteriorates the structural properties of the stud. The cost to rectify the mistakes are increased and construction progress can be delayed.

Thus a particular problem occurs when a carpenter has handed over a building project to plumbers and electricians. A plumber can cut into the stud incorrectly since they have limited understanding of the structural integrity of the stud compared to the carpenter when installing services such as gas pipelines.

Furthermore, when the utility services are housed within the pre-cut holes provided along the web of the stud, there is no method by which cables, pipes and hoses can be securely affixed to the stud to ensure positive, safe installation, limitation of movement of the service once it is commissioned and longevity following disaster events. Movement of the service, such as the flow of water or constant charge/discharge of pressure, may cause wear and tear on the service and fatally damage the service. Interaction between unsecured services and building components such as studs walls, can create unwanted noise such as knocking or creaking. In the event of an earthquake or similar natural disaster, buildings of high importance are required to remain fully functional following the disaster. This includes buildings such as emergency hospitals and medical laboratories. During an earthquake, the services could be forced to move excessively, or be caused to stretch or contract, due to the dynamic movement of the building, which could lead to damage of the services. If that service was vitally important to the function of a particular area of the building, such as the provision of oxygen to an emergency operating theatre, that area would be rendered unusable and limit the service provided to emergency patients.

It may be possible to create a positive fixing between the utility service and the stud using additional fixtures and brackets. Such fixings add additional cost and time to the construction of a building and rely on the mechanical trade crews to ensure that the fixing method is both compliant and adequate for the expected amount of movement. Such assurance can generally only be provided by a suitably qualified engineer, which adds further cost and time to the project.

The present invention aims to provide an improved stud that will not require mechanical trade crews to cut into the stud or manipulate it in any way in order to install the utility services. Thus, the present invention aims to retain the structural integrity of the stud which reduces the chances of it being tampered with to suit installations for the purposes of housing utility services. Furthermore, the present invention aims to provide a method for securely fixing the utility services to the stud. Thus the present invention aims to reduce the risks posed by unsecured utility services by providing an engineered, compliant fixing method that does not require additional parts or interaction with the stud.

SUMMARY OF THE INVENTION

According to a first aspect of the invention, there is provided a building stud comprising:

- a web and first and second flanges formed with and depending from said web;
- a member formed in said web by a continuous cut made in said web and located in an operable position in which the member is not located in the plane of the web;
- an aperture formed in the web resulting from the member being located in said operable position;
- wherein at least one conduit or cable is adapted to be secured to said member and extends through said aperture.

Preferably the member is moved from a position in which the member is located in the plane of the web to said operable position.

Preferably, the member is substantially perpendicular to the plane of the web.

Preferably the aperture is located substantially in a central portion of the web.

Preferably the member has a plurality of slits and openings for securing the at least one conduit or cable to the foldable member.

Preferably the at least one cable or conduit is adapted to be secured to the member using securing means and using the plurality of openings and slits.

Preferably, said member has at least one recess formed in a side of said member.

According to a second aspect of the invention, there is provided a building stud assembly including a plurality of spaced-apart building studs, each building stud comprising:

- a web and first and second flanges formed with and depending from said web;
- a member formed in said web by a continuous cut made in said web and located in an operable position in which the member is not located in the plane of the web;
- an aperture formed in the web resulting from the member being located in said operable position; said aperture being at substantially the same height with respect to ground as one or more corresponding apertures in other studs in the plurality of spaced-apart building studs;
- wherein at least one conduit or cable is adapted to be secured to said member and extend through said aperture and said one or more corresponding apertures in other studs in the plurality of spaced-apart building studs.

BRIEF DESCRIPTION OF THE DRAWINGS

The present invention will hereinafter be described, by way of example only, with reference to the drawings in which.

DETAILED DESCRIPTION OF THE PREFERRED EMBODIMENTS

Figure 1A:
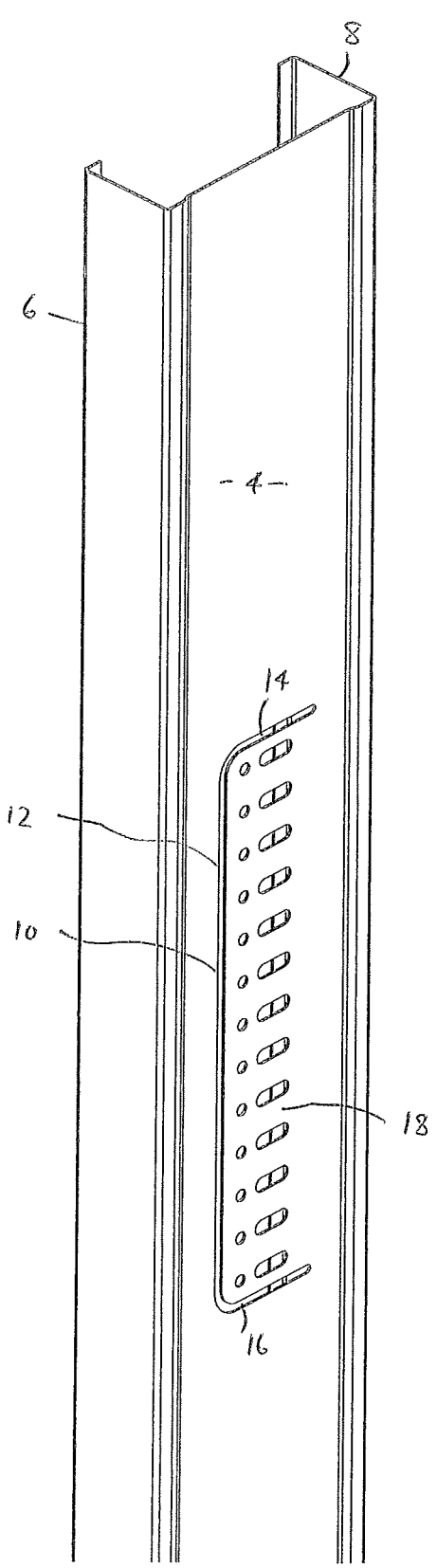
FIGS. 1A and 1B are perspective views according to a first embodiment of a building stud with a cut-out and a member associated with the cut-out being in the plane of a web of the stud.
Figure 1B:
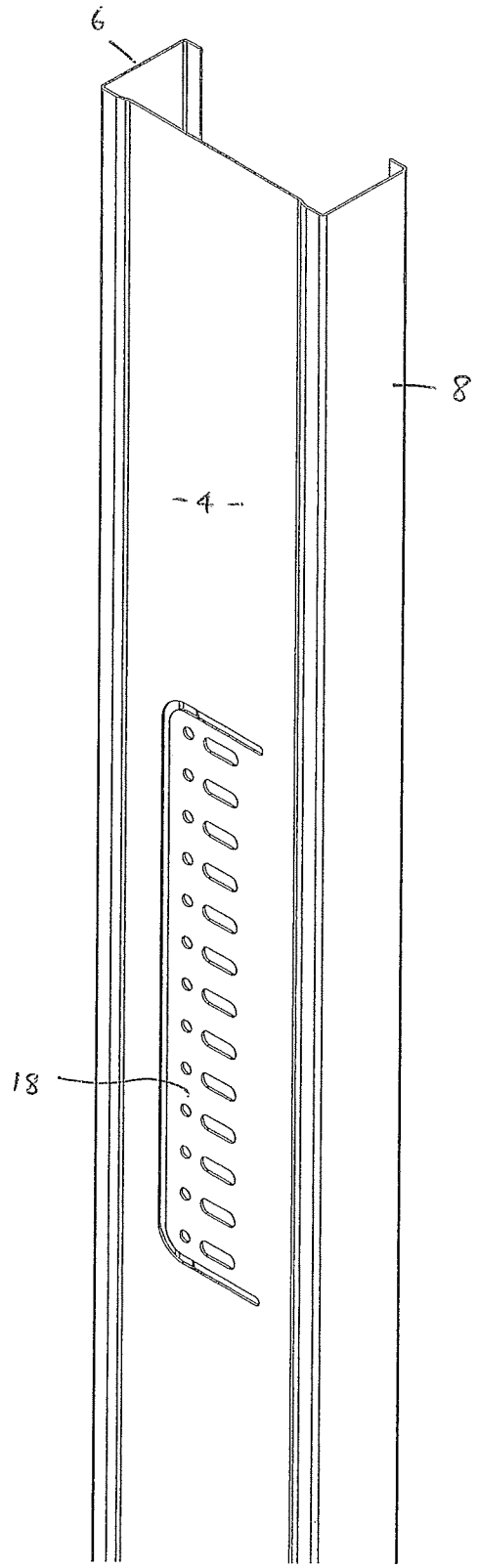
Figure 1C:
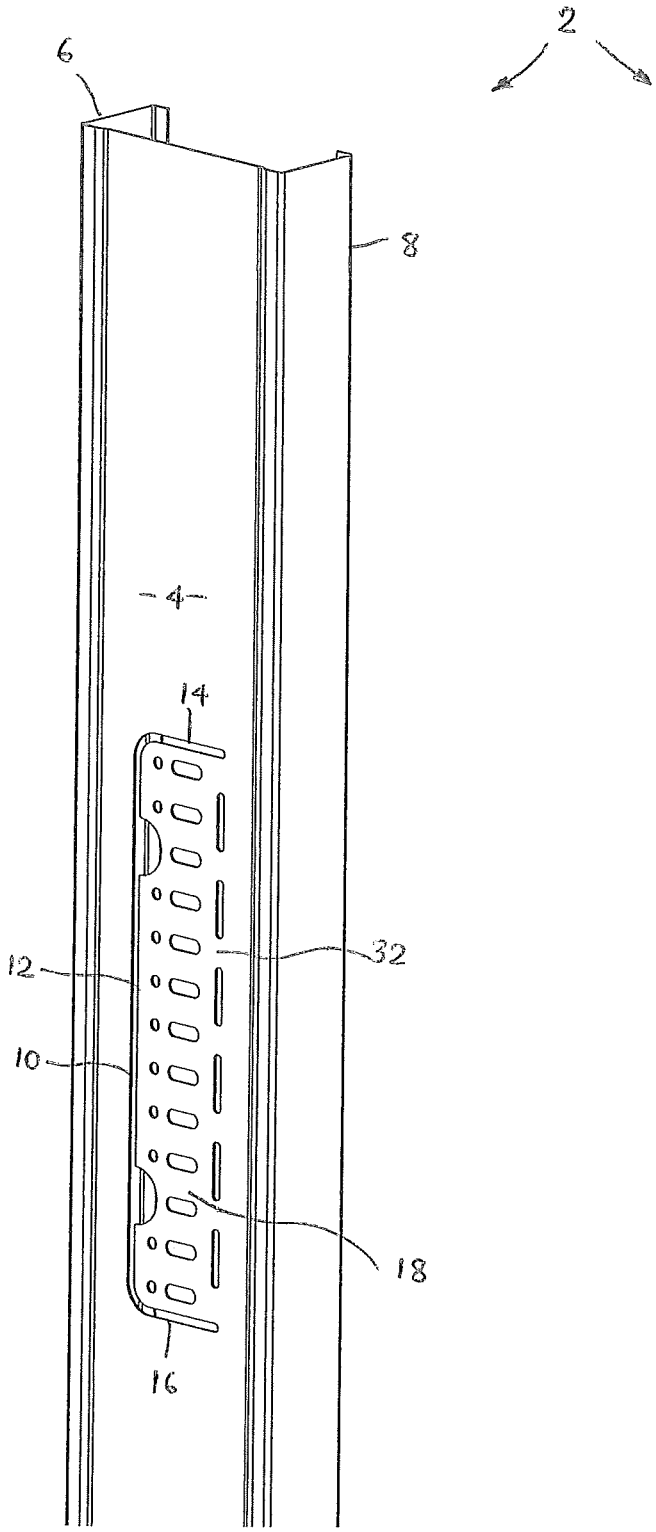
FIGS. 1C and 1D are perspective views according to a second embodiment of a building stud similar to the building stud of FIGS. 1A and 1B, including a pair of recesses in one side of the member.
Figure 1D:
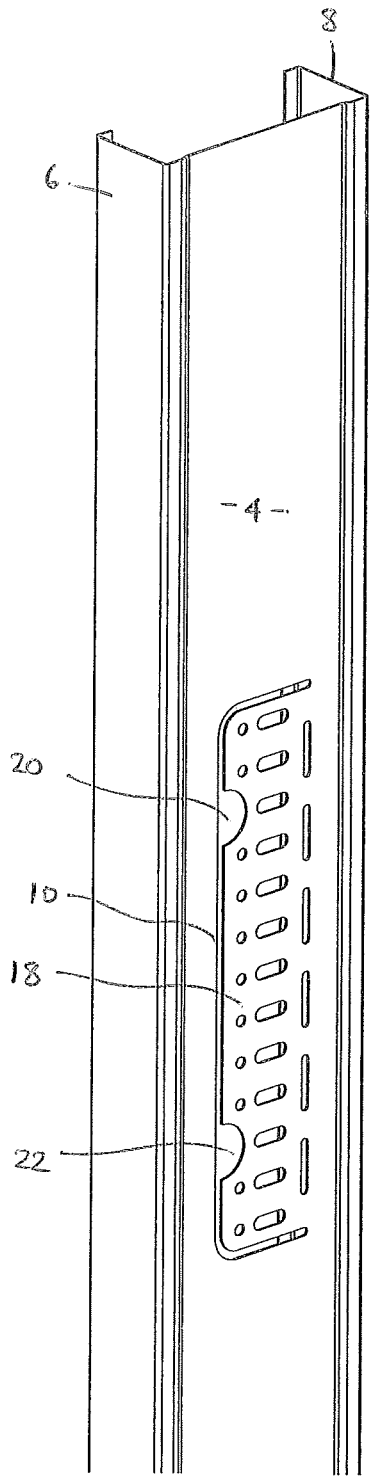

Referring to FIGS. 1A, 1B, 1C and 1D, there is shown a building stud 2 having a web 4, a first flange 6 and a second flange 8, that both are connected to and depend from the web 4 substantially perpendicularly to the plane of the web 4. Located in the web 4 is a cut-out 10 that has a continuous cut of first, second and third cut-out portions 12, 14 and 16 respectively approximately in the shape of three sides of the rectangle. Any suitably shaped cut can be made provided it can accommodate a foldable member and does not affect the structure of the stud 2. A member or tab 18 is so formed from the cut-out 10 and is shown in FIGS. 1A to 1D residing in the plane of the web 4. As many cut-outs 10 that are required can be made in a single stud web 4 in order to allow cables, conduits, pipes and leads to protrude therethrough to carry services such as gas, electricity and water.

Figure 2A:
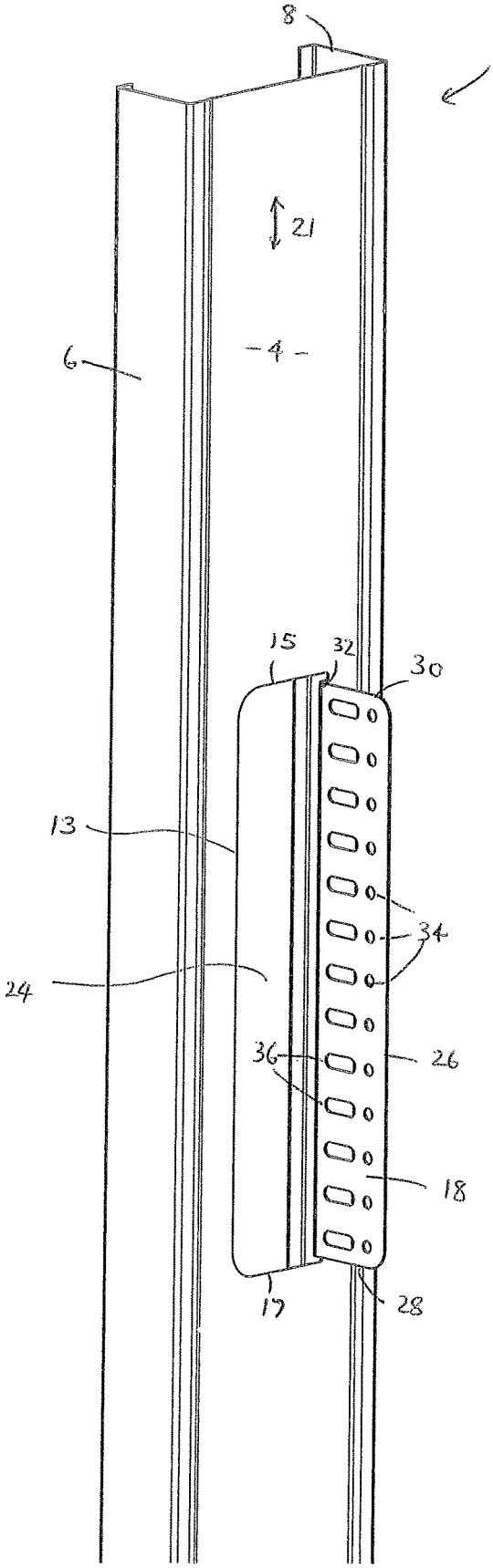
FIGS. 2A and 2B are perspective views of the building stud of FIGS. 1A and 1B with the member positioned outwardly from the plane of the web of the building stud.
Figure 2B:
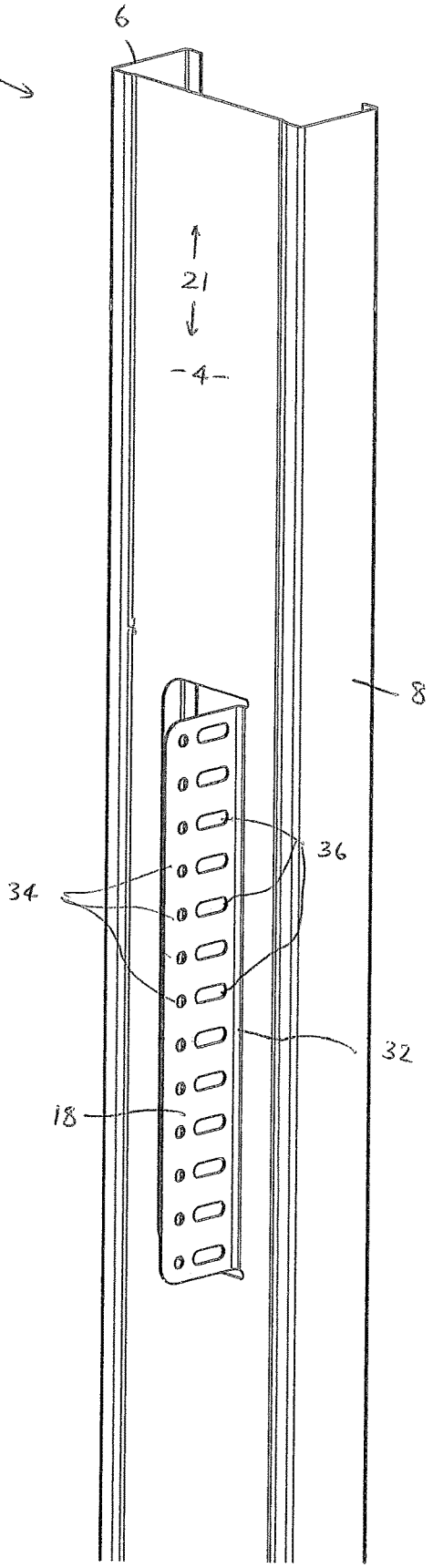
Figure 2C:
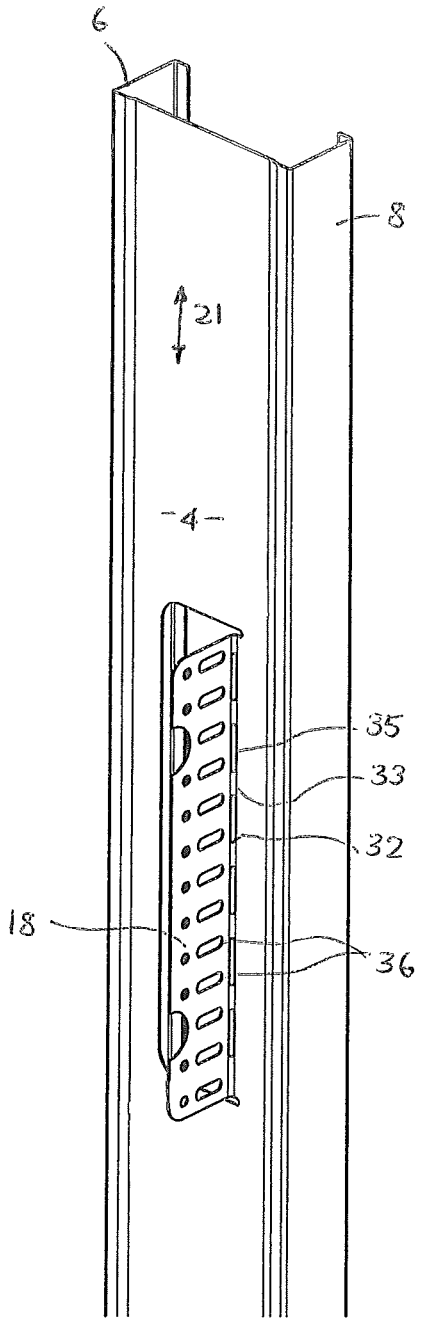
FIGS. 2C and 2D are perspective views of the building stud of FIGS. 1C and 1D with the member positioned outwardly from the plane of the web of the building stud.
Figure 2D:
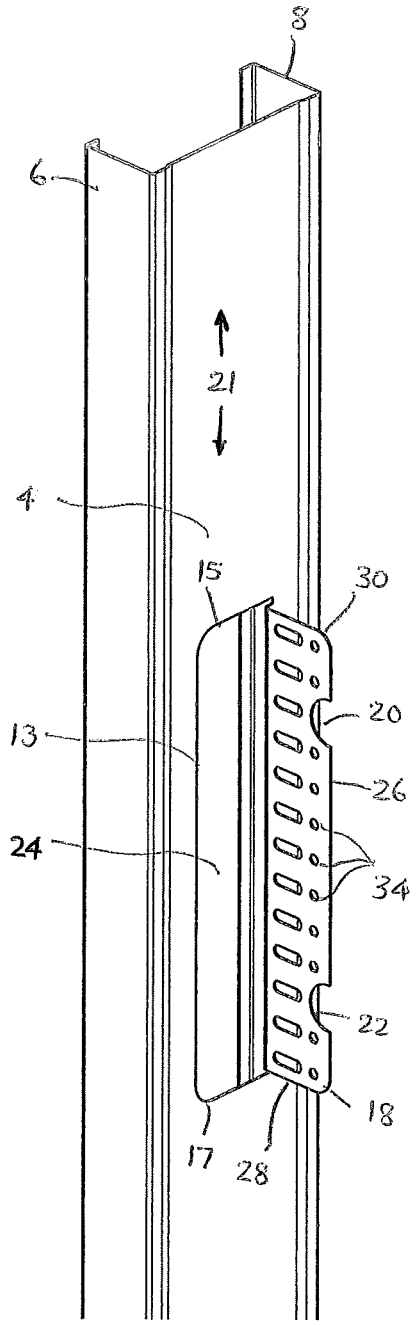
Figure 3A:
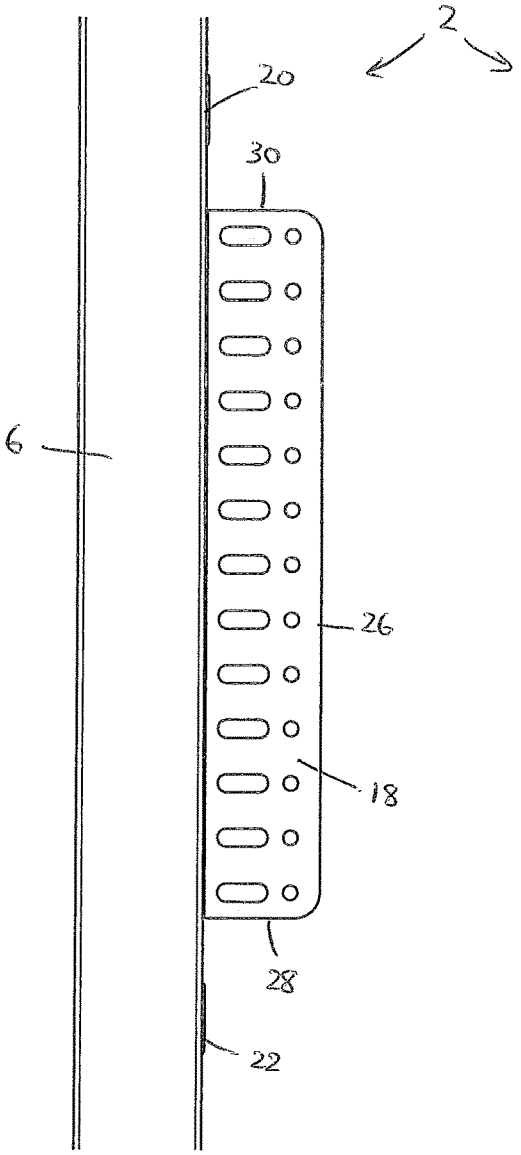
FIGS. 3A and 3B are respectively left and right side views of the building stud of FIG. 2A and FIG. 2B.
Figure 3B:
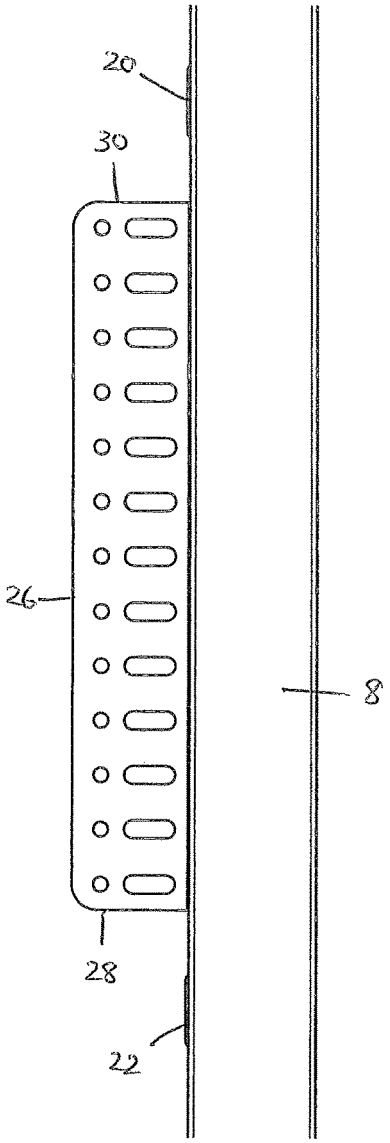
Figure 4A:
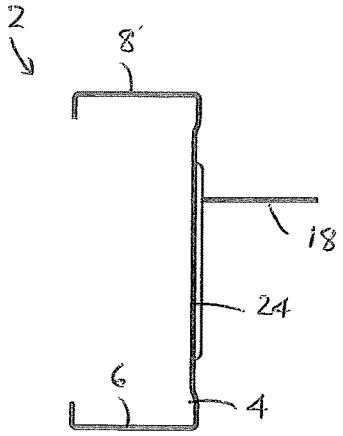
FIG. 4A is a top or plan view of the building stud of FIG. 2A.
Figure 5A:
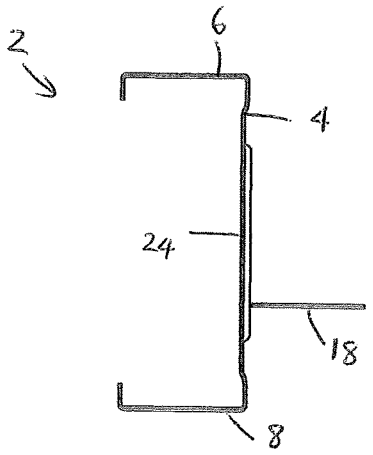
FIG. 5A is an underneath or bottom view of the building stud of FIG. 2A.
Figure 3C:
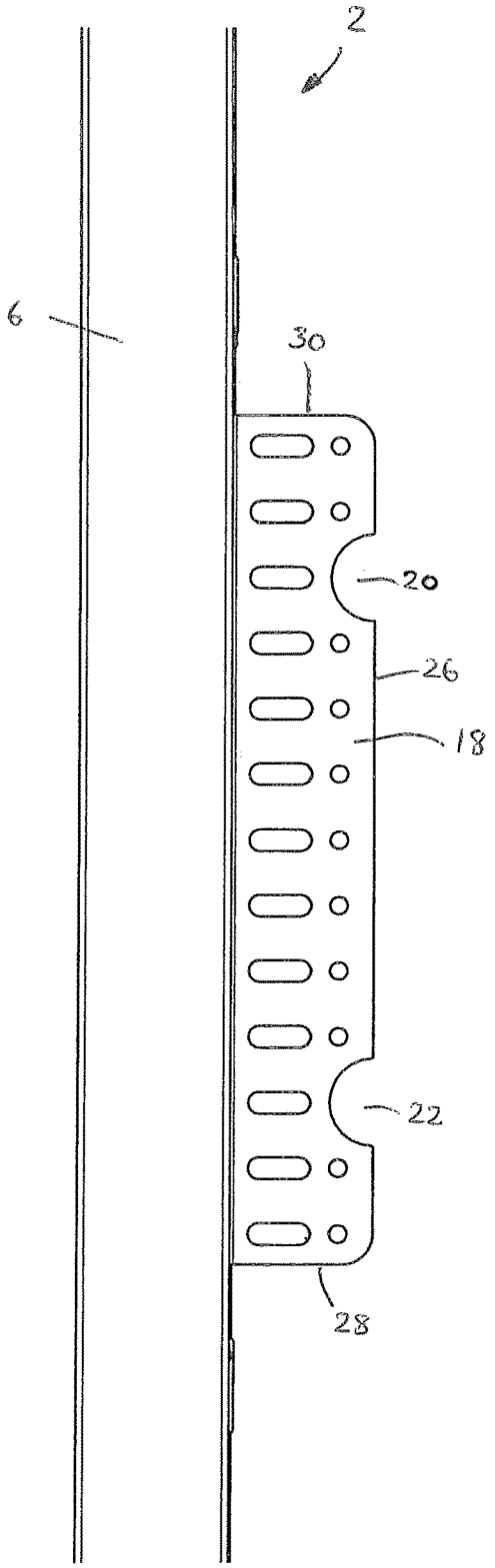
FIGS. 3C and 3D are respectively left and right side views of the building stud of FIG. 2C and FIG. 2D.
Figure 3D:
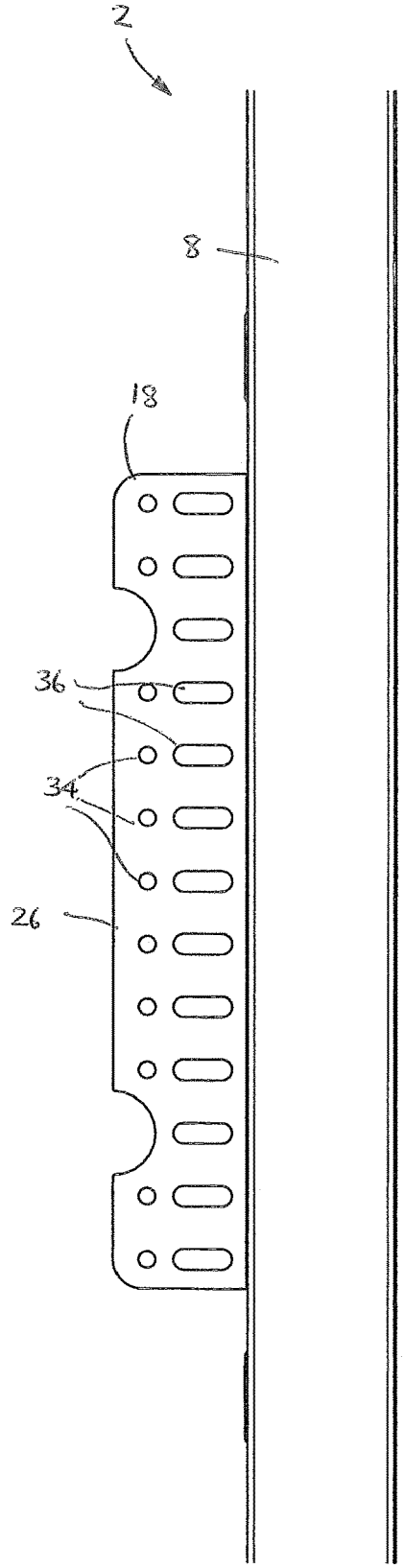
Figure 4B:
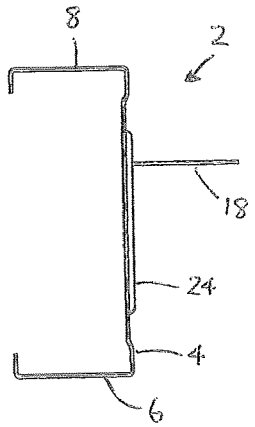
FIG. 4B is a top or plan view of the building stud of FIG. 2C.
Figure 5B:
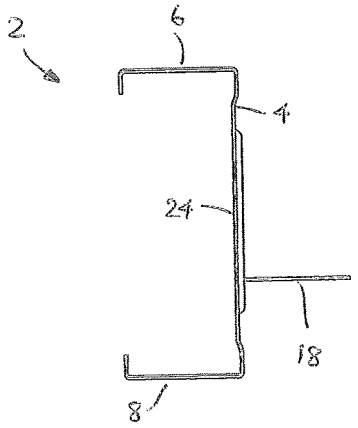
FIG. 5B is an underneath or bottom view of the building stud of FIG. 2C.
Figure 6B:
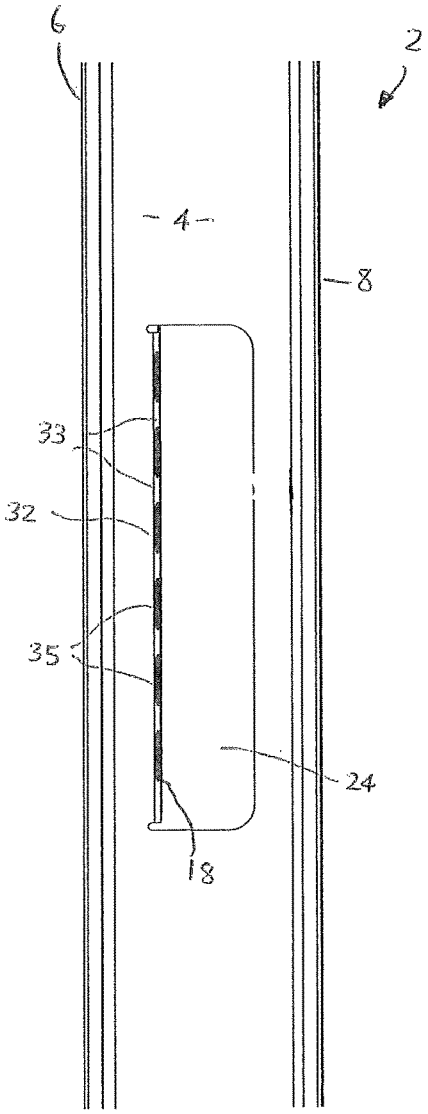
FIG. 6B is a rear view of the building stud of FIG. 2C.
Figure 7B:
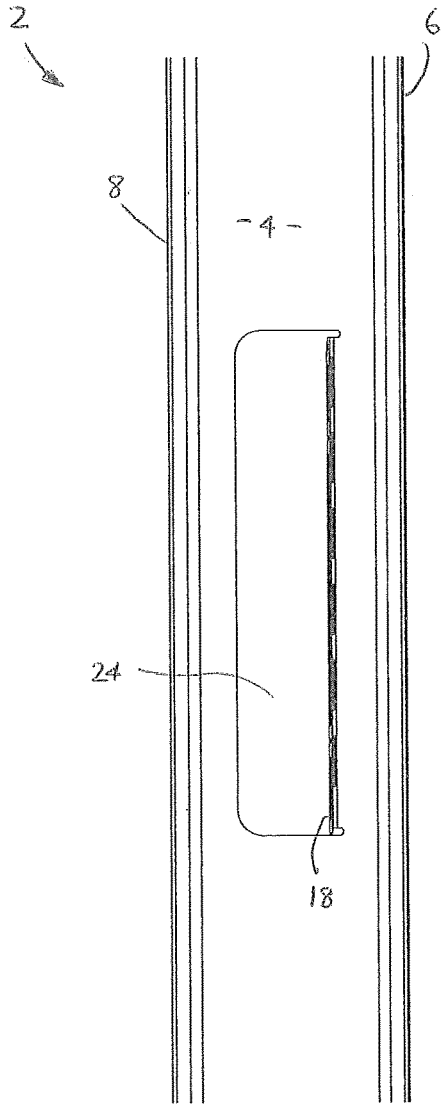
FIG. 7B is a front view of the building stud of FIG. 2C.
Figure 6A:
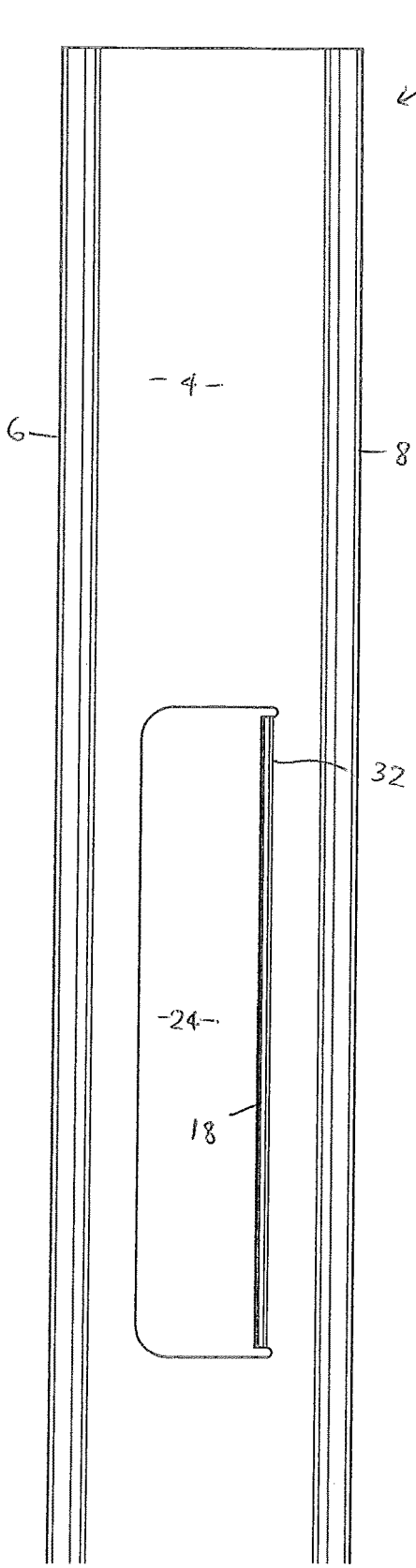
FIG. 6A is a front view of the building stud of FIG. 2A.
Figure 7A:
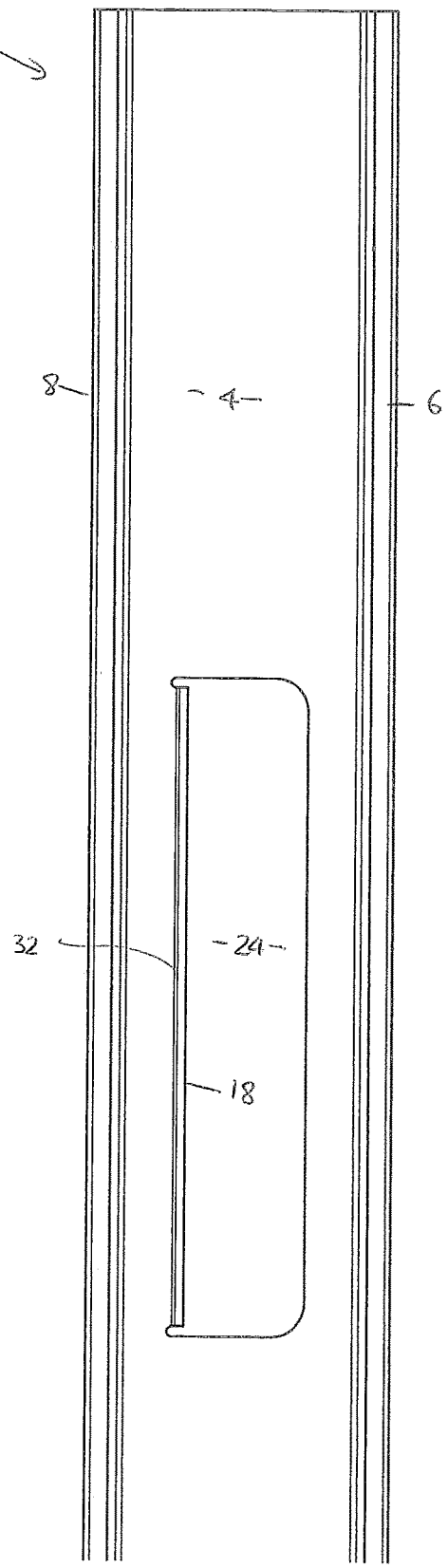
FIG. 7A is a rear view of the building stud of FIG. 2A.

With reference to FIGS. 2A to 7B inclusive, there is shown member 18 extending out of the longitudinal plane 21 of the web 4 approximately perpendicularly to the plane 21. The building stud 2 can be supplied with the member 18 in the operable position shown in FIGS. 2A and 2C, where it is folded or pushed outwardly of the plane of the web 4 from a first or initial position, or it can be supplied with the member 18 in its initial position in the same plane as the web 4. The tab 18 can also be positioned at an angle between zero and ninety degrees with respect to the plane 21 of the web 4 to suit different applications in securing conduits to the tab 18. This can easily be done by a user or a trades person once the stud 2 and several other studs are installed and make up a building component such as a wall. The tab 18, after being pushed outwardly to the operable position, provides a large aperture 24 in the web 4 to enable the conduits and cables to protrude therethrough. The tab 18 has a top edge 30, bottom edge 28, side edge 26 and is hinged to the web 4 through hinge section or folding line 32, that can include a series of slots 35 separated by sections 33. The first cut-out portion 12 is formed between first edge 13 and side edge 26. The second cut-out portion 14 is formed between second edge 15 and top edge 30. The third cut-out portion 16 is formed between third edge 17 and bottom edge 28.

The tab 18 has a series of openings 34 which are generally circular and a series of slits 36 which are elongate and adjacent to the respective smaller openings 34. The stud 4, with its aperture 24 and tab 18, can be one of many that are aligned so that corresponding apertures 24 in successive vertical studs 2 are at the same height to enable easy feed through of the conduits and cables. The tab 18 also has a pair of recesses 20 and 22 in side edge 26 for ease of gripping the tab 18 by finger when moving the tab 18 into or out of plane 21. At least one such recess can be formed in side edge 26.

Figure 8A:
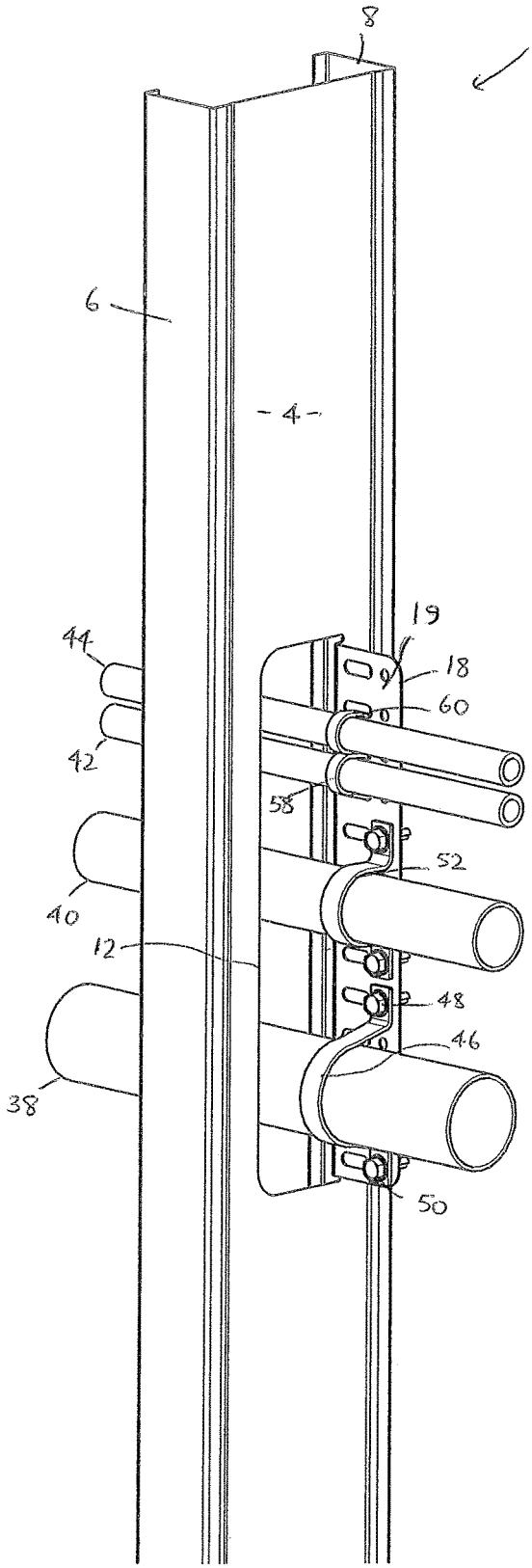
FIGS. 8A and 8B are perspective views of the building stud of FIGS. 2A and 2B respectively with conduits or cables secured to the member formed from the cut-out in the building stud.
Figure 8B:
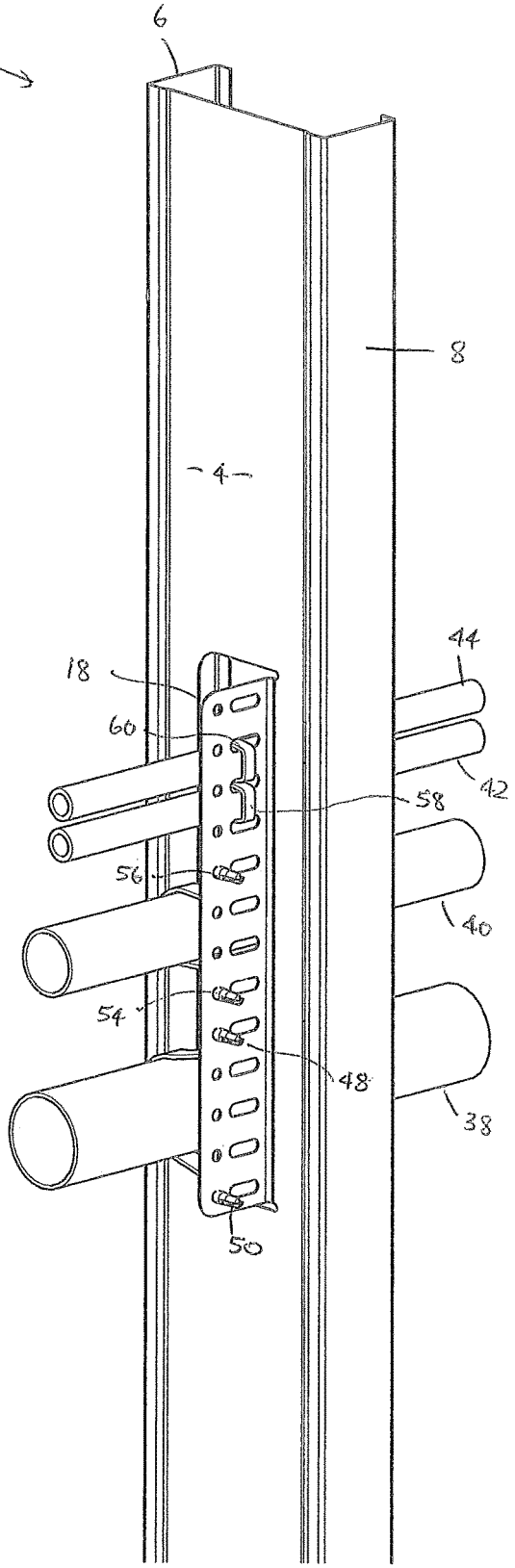
Figure 8C:
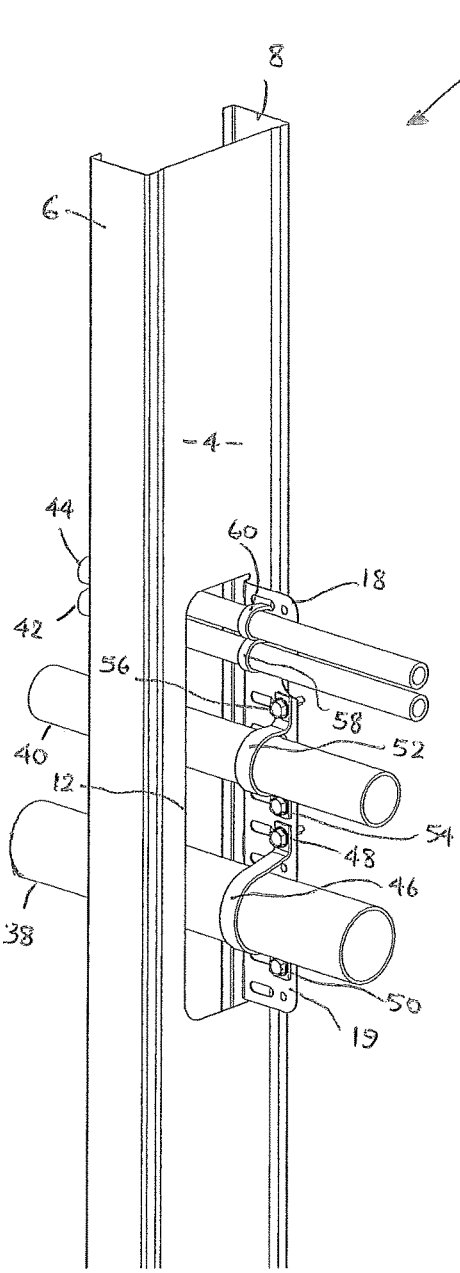
FIGS. 8C and 8D are perspective views of the building stud of FIGS. 2C and 2D respectively with conduits or cables secured to the member formed from the cut-out in the building stud.
Figure 8D:
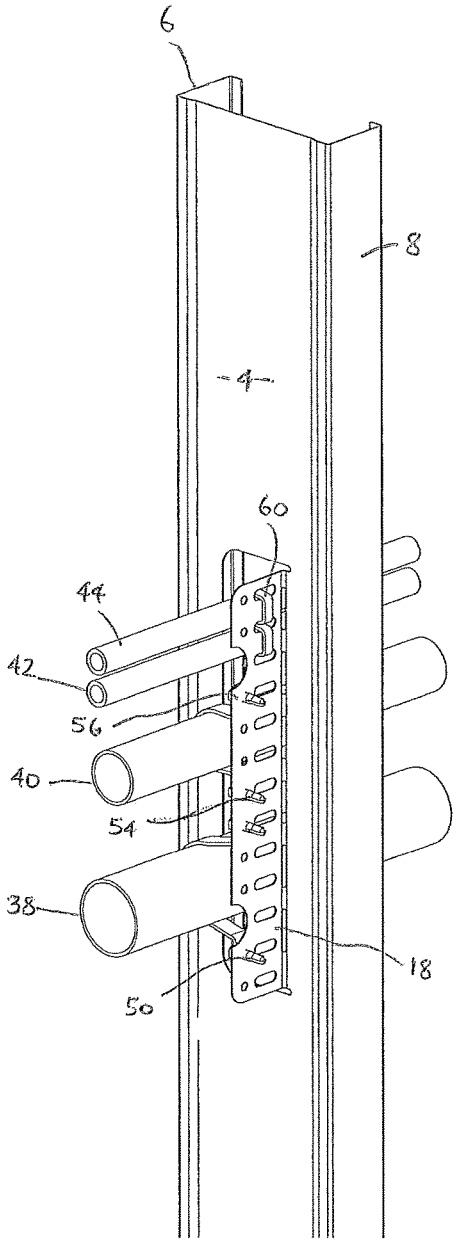

Referring to FIGS. 8A, 8B, 8C and 8D, there is shown an installation of elements 38, 40, 42 and 44 that are positioned and extended through aperture 24 of building stud 2. The elements 42 and 44 could be cables, conduits, tubes, pipes or leads that are respectively fastened or secured to an inside surface 19 of tab 18. This is done through fasteners 60 and 58 respectively. A larger element 40, compared to elements 42 and 44, can also be a conduit, pipe, lead, cable or tube, that is secured to the inside surface 19 of tab 18 via a fastening device that has a member 52 that wraps around the element 40 and is secured to the tab 18 through securing means such as screws or rivets 54 and 56. An even larger element 38, compared to element 40, also can also be a conduit, pipe, cable, lead or tube that is secured to the inside surface 19 and tab 18 through a securing device that includes a portion 46 that wraps around and contacts the outer surface of the element 38 and is secured to the tab 18 through securing devices such as screws or fasteners 48 and 50. All of the fasteners use any combination of the openings 34 and slits 36 and this is repeated for each of the studs 2 that might make up a wall or other building component where the elements 38, 40, 42 and 44 are required to be secured to many studs 2.

In this manner there is usually a space left between the first edge 13 of the cut-out portion 10 and the largest conduit or cable, so that there is no need to attach a grommet to protect the cable. The cables and conduits 38, 40, 42 and 44 therefore do not come into contact with any of the edges 13, 15 or 17. Furthermore there would not be a need for a trades person to tamper with or in any other way modify the shape of the aperture 24 to fit the servicing cables and conduits. It would be a simple process to feed each cable or conduit (element) through the respective apertures 24 that are at substantially the same height, with respect to ground or the same surface, as one or more corresponding apertures among the other studs 2 that make up a plurality of spaced-apart building studs, and then easily secure at each stud 2 and to each tab 18 the particular conduits or cables that are to service the property.

The invention claimed is:

1. A building stud comprising:

a web and first and second flanges formed with and depending from said web;

a member formed in said web by a continuous cut made in said web and located in an operable position in which the member is not located in a plane of the web;

an aperture formed in the web resulting from the member being located in said operable position;

wherein at least one conduit or cable is adapted to be secured to said member and extends through said aperture;

an elongated securing device having opposite first and second terminal ends with a middle extent extending therebetween, at least one of said first and second terminal ends adapted to be secured to said member at a location offset and adjacent the conduit or cable with said middle extent extending from said offset location and wraps around at least a portion of an outer surface of the cable or conduit with no penetration of the conduit or cable outer surface and thereby securing the conduit or cable in a fixed position within said aperture.

2. A building member according to claim 1 wherein the member is moved from a position in which the member is located in the plane of the web to said operable position.

3. A building stud according to claim 1 wherein said operable position of said member is substantially perpendicular to the plane of said web.

4. A building stud according to claim 1 wherein said aperture is located substantially in a central portion of said web.

5. A building stud according to claim 1 wherein said member has a plurality of slits and openings for securing said at least one of said first and second terminal ends to said member.

6. A building stud according to claim 5 wherein said at least one of said first and second terminal ends is adapted to be secured to said member using securing means and using said plurality of openings and slits.

7. A building stud according to claim 1 wherein said member has at least one recess formed in a side of said member.

8. A building stud assembly including a plurality of spaced-apart building studs, each building stud comprising:

a web and first and second flanges formed with and depending from said web;

a member formed in said web by a continuous cut made in said web and located in an operable position in which the member is not located in a plane of the web;

an aperture formed in the web resulting from the member being located in said operable position; said aperture being at substantially the same height with respect to ground as one or more corresponding apertures in other studs in the plurality of spaced-apart building studs; and a securing device anchored to the member;

wherein at least one conduit or cable is adapted to be secured to said member and extend through said aperture and said one or more corresponding apertures in other studs in the plurality of spaced-apart building studs, and wherein the securing device grasps the conduit or cable to secure the conduit or cable to the member.

9. An assembly, comprising:

a web for securing to a stud in a building;

a tab formed in the web by a continuous cut-out in the web, the tab protruding from the web by an angle of no more than ninety degrees, the tab forming an aperture in the web configured to receive a cable, conduit, or pipe through the aperture;

a plurality of openings in the tab; and a securing device anchored in one or more of the openings, the securing device being configured to hold the cable, conduit, or pipe to support the cable, conduit, or pipe to the tab.

10. The assembly of claim 9 wherein the tab is connected to the web with a series of slots and sections forming a perforation that allows the tab to bend relative to the web.

11. The assembly of claim 9 wherein the securing device does not penetrate the cable, conduit, or pipe.

12. The assembly of claim 9 wherein the openings are arranged in a linear fashion in a direction generally parallel with the stud.

13. The assembly of claim 9, further comprising a plurality of slits, wherein each opening has a corresponding slit.

14. The assembly of claim 13 wherein the openings and slits are arranged in a linear fashion in a direction generally parallel with the stud.

* * * * *